US009660389B2

(12) United States Patent
Gao et al.

(10) Patent No.: US 9,660,389 B2
(45) Date of Patent: May 23, 2017

(54) ADDITIONAL GROUND PATHS FOR CONNECTORS HAVING REDUCED PIN COUNTS

(71) Applicant: APPLE INC., Cupertino, CA (US)

(72) Inventors: Zheng Gao, San Jose, CA (US); Min Chul Kim, Los Altos, CA (US); Colin Abraham, Mountain View, CA (US); Nathan Ng, Fremont, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/720,935

(22) Filed: May 25, 2015

(65) Prior Publication Data

US 2015/0340815 A1 Nov. 26, 2015

Related U.S. Application Data

(60) Provisional application No. 62/003,004, filed on May 26, 2014.

(51) Int. Cl.

| | |
|---|---|
| ***H01R 13/648*** | (2006.01) |
| ***H01R 13/6581*** | (2011.01) |
| ***H01R 24/60*** | (2011.01) |
| *H01R 107/00* | (2006.01) |

(52) U.S. Cl.

CPC ..... *H01R 13/6581* (2013.01); *H01R 24/60* (2013.01); *H01R 2107/00* (2013.01)

(58) Field of Classification Search

CPC . H01R 13/6581; H01R 24/60; H01R 2107/00

USPC ..... 439/607.01, 637, 660, 607.4

See application file for complete search history.

(56) References Cited

U.S. PATENT DOCUMENTS

| | | | | | |
|---|---|---|---|---|---|
| 4,544,227 | A * | 10/1985 | Hirose | H01R 13/6583 | 439/607.17 |
| 4,734,041 | A * | 3/1988 | Bruchmann | H01R 12/82 | 439/637 |
| 4,927,382 | A * | 5/1990 | Huber | H01R 13/641 | 340/687 |
| 5,024,609 | A * | 6/1991 | Piorunneck | H01R 12/721 | 439/60 |
| 5,080,613 | A * | 1/1992 | Orui | H01R 12/737 | 439/188 |
| 5,088,931 | A * | 2/1992 | Niciolo | H01R 13/7034 | 439/188 |
| 5,622,522 | A * | 4/1997 | Tan | H01R 12/7052 | 439/607.28 |

(Continued)

*Primary Examiner* — Abdullah Riyami
*Assistant Examiner* — Nelson R Burgos-Guntin
(74) *Attorney, Agent, or Firm* — Kilpatrick Townsend & Stockton, LLP

(57) ABSTRACT

Low cost ground connections for standard connectors and connectors having reduced pin counts. One example may provide a connector system including a connector insert having a plurality of contacts along a top or bottom, or both top and bottom, of a connector insert, where first contacts in the plurality of contacts may be used to convey power, ground, or data and where second contacts in the plurality of contacts are used for ground. The second contacts may be arranged to have contacting portions that are positioned in the insert at different heights relative to the top or bottom of the connector insert and at different depths relative to a front opening of the connector insert.

21 Claims, 8 Drawing Sheets

(56) References Cited

U.S. PATENT DOCUMENTS 6,155,872 A * 12/2000 Wu ..... H01R 13/514 439/541.5
6,439,931 B1 * 8/2002 Niitsu ..... H01R 23/6873 439/660
7,217,146 B2 * 5/2007 Meister ..... H01R 13/443 439/148
7,686,646 B2 * 3/2010 Lee ..... H01R 12/7047 439/567
2002/0004337 A1 * 1/2002 Chiang ..... H01R 12/7023 439/607.01
2002/0115346 A1 * 8/2002 Yip ..... H01R 13/6585 439/607.27
2004/0058572 A1 * 3/2004 Fromm ..... H01R 13/514 439/101
2004/0127097 A1 * 7/2004 Korsunsky ..... H01R 13/652 439/607.01
2004/0180577 A1 * 9/2004 Zhang ..... H01R 13/506 439/607.04
2004/0198073 A1 * 10/2004 Sloey ..... H01R 13/6581 439/39
2004/0242070 A1 * 12/2004 Inoue ..... H01R 13/65802 439/607.01
2006/0046577 A1 * 3/2006 Shibuya ..... H01R 12/7076 439/660
2007/0155240 A1 * 7/2007 Wan ..... H01R 13/65802 439/607.01
2009/0186528 A1 * 7/2009 Chen ..... H01R 13/6477 439/660
2009/0298334 A1 * 12/2009 Takahashi ..... H01R 12/7011 439/607.01
2013/0288537 A1 * 10/2013 Simmel ..... H01R 13/6583 439/660
2015/0200493 A1 * 7/2015 Gao ..... H01R 13/6582 439/607.28
2015/0295362 A1 * 10/2015 Tziviskos ..... H01R 13/6581 439/607.01
2015/0340813 A1 * 11/2015 Ng ..... H01R 13/646 439/607.28
2015/0340815 A1 * 11/2015 Gao ..... H01R 13/6581 439/607.01
2015/0340825 A1 * 11/2015 Ng ..... H01R 24/70 439/607.28

* cited by examiner

ADDITIONAL GROUND PATHS FOR CONNECTORS HAVING REDUCED PIN COUNTS

CROSS-REFERENCES TO RELATED APPLICATIONS

This application claims the benefit of U.S. provisional application No. 62/003,004, filed on May 26, 2014, which is incorporated by reference.

BACKGROUND

The amount of data transferred between electronic devices has grown tremendously the last several years. Large amounts of audio, streaming video, text, and other types of information content are now regularly transferred among desktop and portable computers, media devices, handheld media devices, displays, storage devices, and other types of electronic devices.

Data may be conveyed over cables that may include wire conductors, fiber optic cables, or some combination of these or other conductors. Cable assemblies may include a connector insert at each end of a cable, though other cable assemblies may be connected or tethered to an electronic device in a dedicated manner. The connector inserts may be inserted into receptacles in the communicating electronic devices.

These connector inserts may include contacts or pins that form signal paths with contacts or pins in the corresponding connector receptacles. These signal paths may radiate signal noise to nearby signal paths and electrical circuits. These signal paths may also receive signal noise from nearby signal paths and electrical circuits. Accordingly, it may be desirable to shield these signal paths such that they do not radiate or receive this signal noise.

Also, while these connectors may be fully compliant with one or more various signaling interfaces, other connectors may be only partially compliant with these signaling interfaces. For example, in a connector intended to be used for charging, one or more signal pins may not be needed and may be omitted. However, some signal paths may remain. Further, it may be desirable to shield the power pins on such a connector.

Moreover, various connectors may sell in the millions of units. With these volumes, even a minor cost reduction can lower expenses significantly.

Thus, what is needed are connector inserts that may provide shielding in a low-cost manner in standard connectors and connectors having reduced pin counts.

SUMMARY

Accordingly, embodiments of the present invention may provide shielding in a low-cost manner in standard connectors and connectors having reduced pin counts. An illustrative embodiment of the present invention may provide a connector system including a connector insert having a plurality of contacts along a top or bottom, or both top and bottom, of a connector insert, where first contacts in the plurality of contacts may be used to convey power, ground, or data and where second contacts in the plurality of contacts may be used to convey ground. The second contacts may be arranged to have contacting portions that are positioned in the insert at different heights relative to the top or bottom of the connector insert and at different depths relative to a front opening of the connector insert, as compared to contacting portions of the first contacts.

In various embodiments of the present invention, the first contacts may convey signals and power compliant with one or more interface standards. In other embodiments of the present invention, the first contacts and the second contacts together may convey signals and power compliant with one or more interface standards. In other embodiments of the present invention, the connector insert may be intended for use in a charger or other application where one or more signal or other contacts of an interface standard may not be needed. In these embodiments, the signal or other contacts that are not needed may be replaced by ground contacts. These ground contacts may provide shielding, current returns, and other functions. These ground contacts may replace other grounding structures that would otherwise be employed, thereby simplifying the connector insert, saving space, and reducing costs.

In various embodiments of the present invention, the first and second contacts may be formed as a unit. That is, the first and second contacts may be formed or manufactured at the same time as part of the same stamping, molding, or printing operation. This may eliminate the need to form or manufacture a separate grounding structure, again, simplifying the connector insert and reducing costs.

Another illustrative embodiment of the present invention may provide a connector system including a connector receptacle having a tongue. The tongue may include a number of signal contacts for connecting signals, power, ground, or other data or supply voltages. The signal contacts may be on a bottom side of the tongue, a top side of the tongue, or both. The tongue may further include a ground contact behind the signal contacts such that the signal contacts are located between the ground contact and a front opening of the connector receptacle. The ground contact may be on a bottom side of the tongue, a top side of the tongue, or both. The ground contact may be elevated on a top side above the tongue and on a bottom side below the tongue. This embodiment may include a connector insert to mate with this connector receptacle. The connector insert may have a front opening having a major axis. For reference purposes, a centerline may be located in the center of the front opening along the major axis. The connector insert may have first contacts to form electrical connections with the signal contacts on the tongue of the connector receptacle. The connector insert may have second contacts to form electrical connections with the raised ground contacts behind the signal contacts in the connector receptacle. The first and second contacts may be located along a bottom of a front opening of the connector insert, along a top of the front opening of the connector insert, or both.

In this and other embodiments of the present invention, the first contacts may have first contacting portions to contact the signal contacts on the connector receptacle tongue, while the second contacts may have second contacting portions to contact the ground contacts on the connector receptacle tongue. The first contacting portions may be closer to the centerline of the front opening of the connector insert as compared to the second contacting portions. The first contacting portions may be located at a greater depth or distance from the front opening as compared to the second contacting portions.

In another illustrative embodiment of the present invention, the first and second contacts of the connector insert may be formed together as a unit. The unit may be attached to a first molded portion. First contacts along a top of the connector insert, when present, may have a downward sloping portion from the first molded portion to a contacting portion. First contacts along a bottom of the connector insert, when present, may have an upward sloping portion from the first molded portion to a contacting portion. Second contacts along a top of the connector insert, when present, may have an upward first sloping portion from the first molded portion to a shield contacting portion and a downward second sloping portion from the shield contacting portion to a contacting portion. Second contacts along a bottom of the connector insert, when present, may have a downward first sloping portion from the first molded portion to a shield contacting portion and an upward second sloping portion from the shield contacting portion to a contacting portion.

The shield contacting portions may form electrical connections with the shield to provide additional ground paths for shielding and return currents. This may result in ground connections that provide shielding for signals and power supplies in the connector system. Specifically, a shield of a connector insert may connect to a shield of a connector receptacle. The shield of the connector receptacle may connect to a ground contact on a tongue of the connector receptacle. Second contacts in the connector insert may connect to the ground contact on the tongue of the connector receptacle. The second contacts may connect back to the shield of the connector insert at the shield contacting portions. Additional ground paths may be provided by side ground contacts in the connector insert and on the tongue of the connector receptacle.

That is, the second contacts may provide a ground path from a shield of a connector insert to a ground contact in a connector receptacle. When second ground contacts are not used, a separate structure may be needed to the connect shield of the connector insert to the ground contact in a connector receptacle. This structure may be manufactured separately from the first contacts. It may also need to be added to the connector insert in a separate assembly step. It may also use additional space. These factors may increase space, complicate assembly, and increase costs of the connector insert.

Another illustrative embodiment of the present invention may provide a method of manufacturing a connector insert. A first plurality of first and second contacts for a top of the connector insert may be formed, for example by stamping. A second plurality of first and second contacts for a bottom of the connector insert may similarly be formed. A center ground piece may be formed. An injection molded portion may be formed around the center ground piece. The injection molded piece may have slots on a top to accept the first plurality of contacts and slots on a bottom to accept the second plurality of contacts. Additional molded pieces may be placed over the top and bottom of the injection molded piece to secure the first and second pluralities of contacts in place. A front molded portion having an opening may be placed around the contacts such that first contacts on a top and bottom of the insert are located in the opening and such that second contacts on a bottom of the insert are below the front molded portion and second contacts on a top of the insert are above the front molded portion.

In various embodiments of the present invention, contacts and other conductive portions of connector inserts and receptacles may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), or other nonconductive material or combination of materials. The printed circuit boards used may be formed of FR-4, BT or other material. Printed circuit boards may be replaced by other substrates, such as flexible circuit boards, in many embodiments of the present invention.

Embodiments of the present invention may provide interconnect structures that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connector inserts and receptacles may provide pathways for signals that are compliant with one or more various standards such as Universal Serial Bus (USB), a High-Definition Multimedia Interface (HDMI), Digital Visual Interface (DVI), power, Ethernet, DisplayPort, Thunderbolt, Lightning and other types of standard and non-standard interfaces that have been developed, are being developed, or will be developed in the future. Other embodiments of the present invention may provide connector inserts that may be used to provide a reduced set of functions for one or more of these standards. In various embodiments of the present invention, these interconnect paths provided by these connector inserts and receptacles may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF EXEMPLARY EMBODIMENTS

Figure 1:
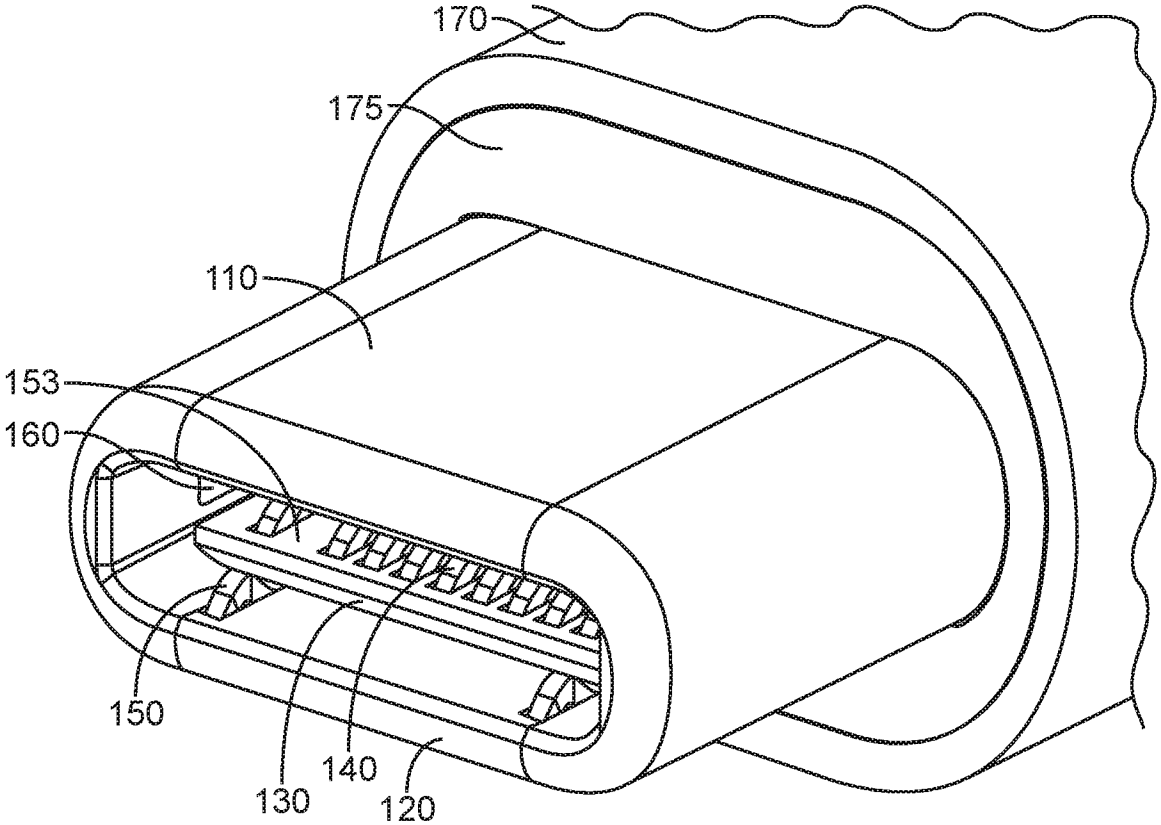
FIG. 1 illustrates a connector insert according to an embodiment of the present invention.

FIG. 1 illustrates a connector insert according to an embodiment of the present invention. This figure, as with the other included figures, is shown for illustrative purposes and does not limit either the possible embodiments of the present invention or the claims.

In this example, a front insert portion may be at least partially surrounded by shield 110. Shield 110 may surround first contacts 140 and second contacts 150. First contacts 140 may be used to convey signals, power, ground, or other data or power supply or bias voltages. Second contacts 150 may be used to convey ground, signals, power, or other data or power supply or bias voltages. In a specific embodiment of the present invention, first pins 140 may be used to convey signals, power, and ground, while second contacts 150 may be ground contacts to provide ground shielding and return current paths.

Shield 110 may be mechanically supported by housing 170. Housing 170 may provide a structure to be handled by a user while inserting this connector insert into a connector receptacle. Housing 170 may be formed of plastic or other nonconductive material and may include a front face 175. Housing 170 may provide a covering for one or more circuits, light-emitting diodes, printed circuit boards, or other electronic circuits or components. Shield 110 may terminate in front portion 120. Shield 110 may be metallic or formed of other conductive material. Front portion 120 may be plastic or other material. Front housing portion 130 may be included to support first contacts 140 and second contacts 150. Front housing portion may be formed of plastic or other nonconductive material.

In various embodiments of the present invention, first contacts 140 may convey the signals, power, ground, or other data or power supply or bias voltages for one or more specific interfaces. In other embodiments of the present invention, a connector insert may only need to convey a reduced set of signals, power, ground, or other data or power supply or bias voltages. For example, where a connector insert may be used to connect an electronic device to a charger, one or more data or signal paths may be eliminated from first contacts 140. In this case, a contact position, shown in this example as contact position 153, may be used for second contacts 150. Again, second contacts 150 may provide a ground connection for shielding or return current. The inclusion of second contacts 150 may allow the removal of one or more other ground structures that would otherwise be needed. This removal may save space in the connector insert, simplify its manufacturing, and reduce costs. This may be particularly true where second contacts 150 may be manufactured at the same time as first contacts 140, as shown in examples below. In this example, a bottom row of first contacts 140 and second contacts 150 are shown, though in other embodiments of the present invention, an upper row of such contacts may also be included.

In this example, first contacts 140 and second contacts 150 may have contacting portions positioned at different depths relative to a front opening of a connector insert. The contacting portions of first contacts 140 and second contacts 150 may also be placed at different heights inside the connector insert. These contacts may be arranged in this way to properly engage contacts in a corresponding connector receptacle. An example of such a connector receptacle is shown in the following figure.

Figure 2:
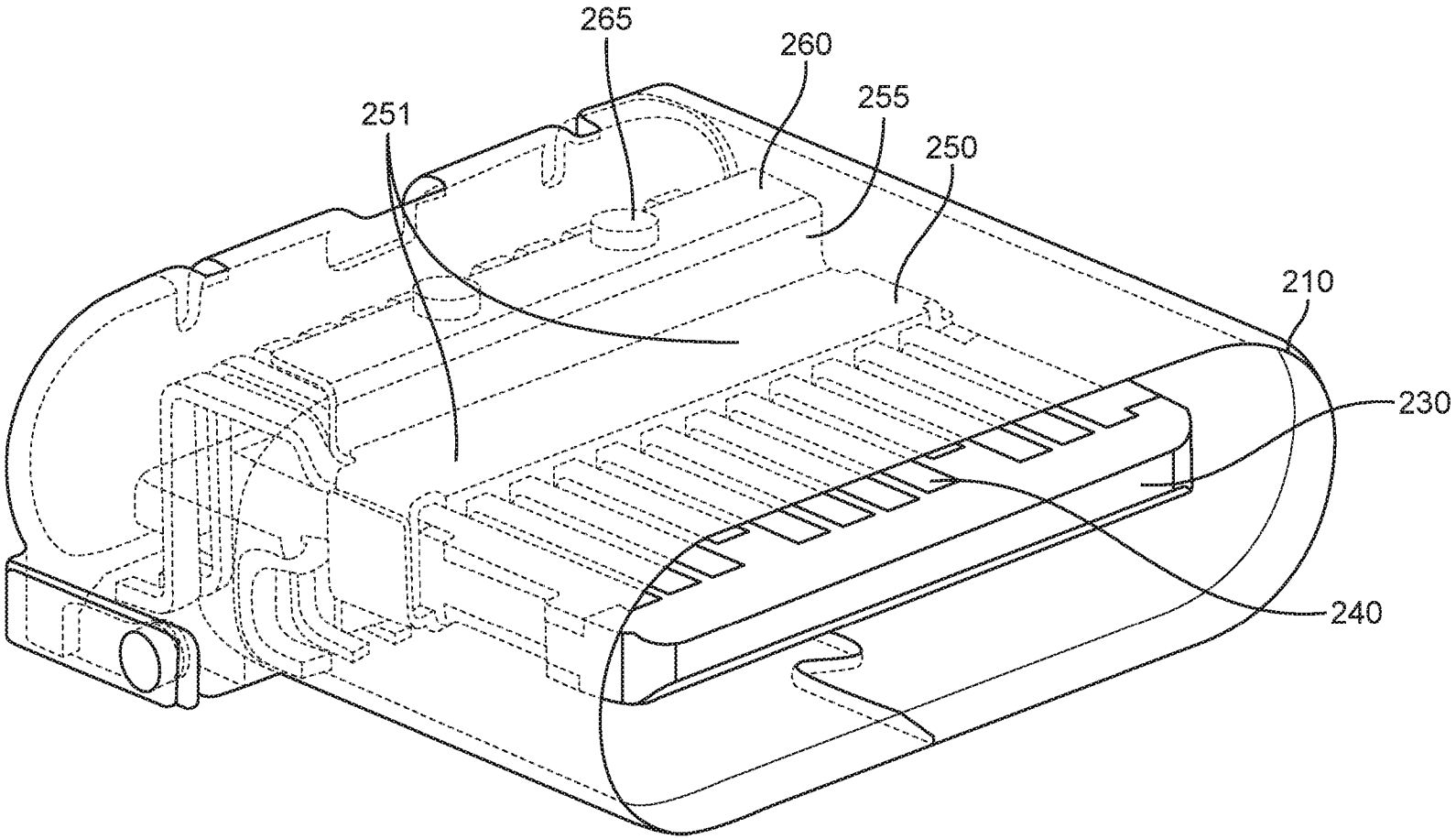
FIG. 2 illustrates a connector receptacle that may mate with connector inserts according to embodiments of the present invention.

FIG. 2 illustrates a connector receptacle that may mate with connector inserts according to embodiments of the present invention. This connector receptacle may include shield 210 surrounding tongue 230. Tongue 230 may support a number of contacts 240. Ground contacts 250 may be located behind contacts 240 such that contacts 240 are between ground contacts 250 and a front opening of a connector receptacle. Ground contact 250 may lead to a front face 255 and an upper ground contact 260. Upper ground contact 260 may be electrically connected to shield 210 through a laser welds at points 265.

In this way, contacts 240 may be located near a front opening of a connector receptacle. Contacts 240 may be flush or substantially flush with a surface of tongue 230. Ground contact 250 may be located behind contacts 240. Ground contact 250 may also be positioned at a height above tongue 230 and contacts 240. Contacts that are the same or similar to contacts 240 and ground contacts 250 may be included on underside of tongue 230.

The connector insert of FIG. 1 may mate with this connector receptacle. Specifically, tongue 230 of the connector receptacle may fit in an opening in the front portion housing 130 of the connector insert. First contacts 140 may form electrical connections with contacts 240 on tongue 230. Similarly, second contacts 150 in the connector insert may form electrical connections at or near point 251 of ground contact 250 of the connector receptacle.

Again, ground contact 250 may be at a different height than contacts 240 in the connector receptacle. Accordingly, first contacts 140 and second contacts 150 the connector insert may have contacting portions at different heights. This is shown in the following figure.

Figure 3:
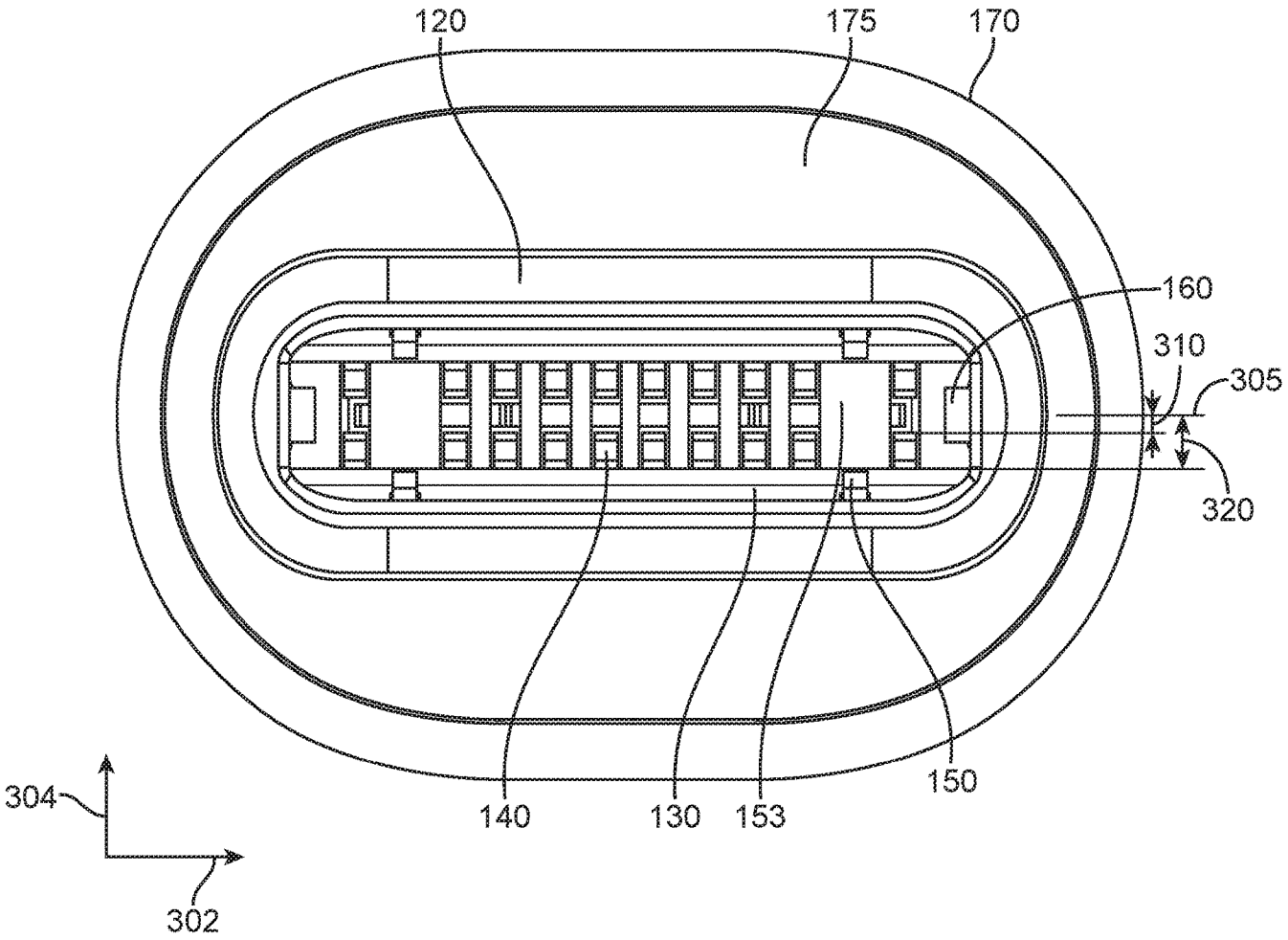
FIG. 3 illustrates a front view of a connector insert according to an embodiment of the present invention.

FIG. 3 illustrates a front view of a connector insert according to an embodiment of the present invention. As before, housing 170 may have a front face 175 supporting a connector insert portion. The connector insert portion may have a front portion 120. The portion 120 may form an opening exposing front housing portion 130, which may support a number of first contacts 140 and second contacts 150.

A front opening of a connector insert formed by front portion 120 may have a major axis, or longer portion, in a direction 302, and a minor axis, or a shorter portion, in direction 304. The front opening formed by front portion 120 may have a centerline 305 along the middle of the opening of along the major axis. First contacts 140 and second contacts 150 may be located along a top and bottom of the front opening formed by front portion 120.

First contacts 140 and second contacts 150 may have contacting portions placed at different distances from center line 305. That is, first contacts 140 and second contacts 150 may have contacting portions placed at different heights in the connector insert relative to a top or bottom of the opening formed by front portion 120. In this example, contacting portions for contacts 140 may be at a shorter distance 310 from center line 305, as compared to contacting portions for second contacts 150, which may be at a distance 320 from center line 305.

Again, first contacts 140 may be compliant with one or more signal standards. In other embodiments of the present invention, one or more contacts may not be needed, for example where the connector insert is connected to a charger. In this case, contact positions 153 may be vacated and used for second contacts 150. Second contacts 150 may provide ground paths. These ground paths may not otherwise be available when contact positions 152 are used by first contacts 140 to meet compliance with one or more interface specifications. The ability to include the extra ground paths provided by second contacts 150 may eliminate the need for one or more other ground structures. This may again reduce space, simplify manufacturing, and reduce costs.

Specifically, ground contacts 150 may provide a ground path from shield 110 of the connector insert to ground contact 250 in a connector receptacle. When second ground contacts 150 are not used, a separate structure may be needed to connect shield 110 of the connector insert to ground contact 250 in a connector receptacle. This structure may be manufactured separately from first contacts 140. It may also need to be added to the connector insert in a separate assembly step. It may also use additional space. These factors may increase space, complicate assembly, and increase costs of the connector insert.

Figure 4:
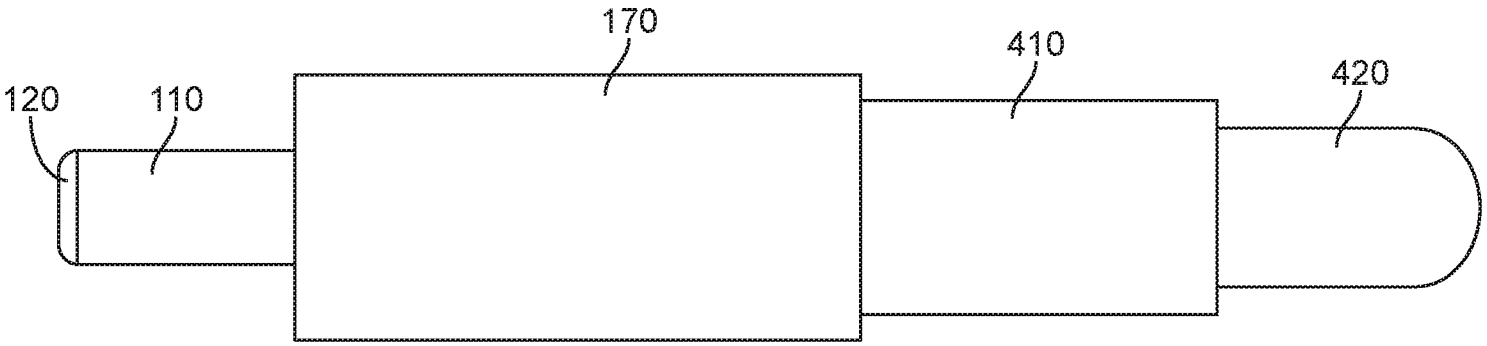
FIG. 4 illustrates a side view of a connector insert according to an embodiment of the present invention.

FIG. 4 illustrates a side view of a connector insert according to an embodiment of the present invention. Again, housing 170 may support a front inserting portion surrounded by shield 110. Shield 110 may be attached to front portion 120. Cable 420 may house a number of conductors (not shown) that may enter housing 170. The conductors may connect to first contacts 140, second contacts 150, or circuits, boards, or other components in housing 170. These circuits, boards, or other components in housing 170 may further connect to first contacts 140 and second contacts 150 in the connector insert. Strain relief 410 may provide protection for cable 420.

Again, first contacts 140 and second contacts 150 in a connector insert according to an embodiment of the present invention may have contacting portions located at different heights. These contacting portions may also be placed at different depths relative to a front opening of the connector insert. To properly place these contacting portions, first contacts 140 and second contacts 150 may have different shapes. An example is shown in the following figure.

Figure 5:
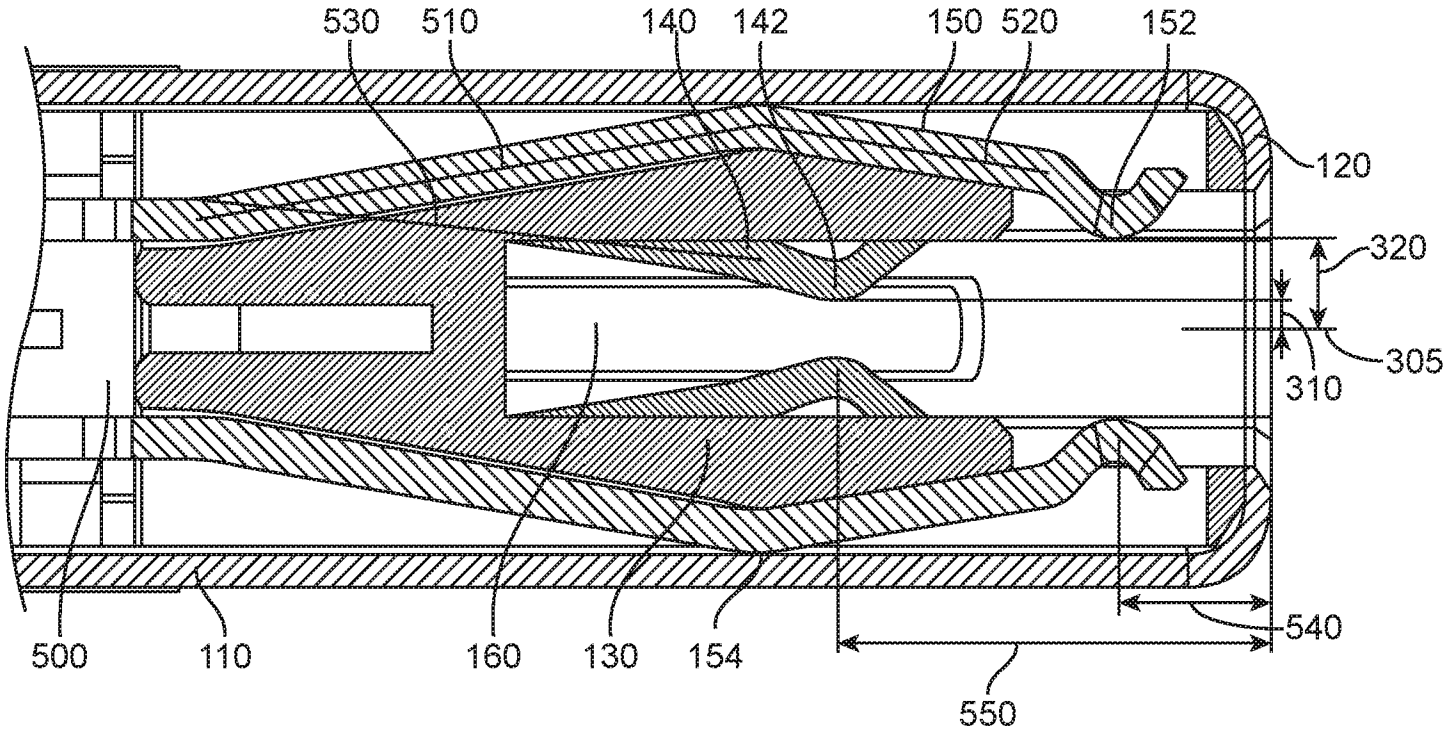
FIG. 5 illustrates a cutaway side view of a connector insert according to an embodiment of the present invention.

FIG. 5 illustrates a cutaway side view of a connector insert according to an embodiment of the present invention. The insertion portion may be surrounded by shield 110, which may support a front portion 120. Front portion 120 may form a front opening in the connector insert. This opening may have a center line at a level 305. The connector insert may include a number of first contacts 140 and second contacts 150 along a top and bottom of the connector insert. First contacts 140 and second contacts 150 may be mechanically supported by first molding portion 500. First contacts 140 may have contacting portions 142 to engage contacts 240 in a connector receptacle. Similarly, second contacts 150 may include contacting portions 152 to engage ground contacts 250 at points 251 in a connector receptacle, as shown in FIG. 2.

As before, contacting portions 142 of first contacts 140 may be at a height or distance 310 from centerline 305. Contacting portions 152 of second contacts 150 may be at a height or distance 320 from centerline 305. In this example, height or distance 310 may be less than height or distance 320. Similarly, first contacting portions 142 of first contacts 140 may be at a depth or distance 550 from a front opening of the connector insert. Second contacting portions 152 of second contacts 150 may be at a depth or distance 540 from a front of a connector insert. In this example, depth or distance 540 may be less than depth or distance 550.

With this configuration, first contacting portions 142 of first contacts 140 may engage contacts 240 in a connector receptacle, while second contacting portions 152 of second contacts 150 may engage ground contacts 250 at points 231. More specifically, contacting portions 142 of first contacts 140 may be closer to centerline 305 to mate with contacts 240 on tongue 230 of the receptacle, while contacting portions 152 of second contacts 150 are further away from centerline 305 to mate with ground contact 250, which resides at a height above tongue 230 in the connector receptacle of FIG. 2. Also, contacting portions 142 of first contacts 140 may be further from a front of the connector insert to mate with contacts 240 on tongue 230 of the receptacle, while contacting portions 152 of second contacts 150 are closer to the front of the connector insert to mate with ground contact 250, which may reside behind contacts 240 on tongue 230 in the connector receptacle of FIG. 2.

To properly position the contacting portions, first contacts 140 and second contacts 150 may have different shapes. First contacts 140 and second contacts 150 may be mechanically supported by first molding portion 500. First contacts 140 may have a generally downward sloping portion 530 from first molding portion 500 to contacting portion 142. Second contacts 150 may include a generally upward sloping portion from first molding portion 500 to shield contacting portion 154, and a generally downward sloping portion 520 from shield contacting portion 154 to contacting portion 152. When contacting portion 152 connects to a ground contact, second contact 150 may electrically connect shield 110 of the connector insert to ground contact 250 in a connector receptacle.

The inclusion of second contacts 150 may provide additional ground contacts. These additional ground contacts may be placed at the locations of pins that are not needed. That is, these additional ground contacts may be placed at an unused contact locations in a reduced pin-count connector insert.

Once this connector insert is inserted into a connector receptacle, such as the connector receptacle in FIG. 2, side ground contacts 160 may form a ground connection with contacts on sides of tongue 210 and may hold the connector insert in place relative to a connector receptacle, such as the connector receptacle of FIG. 2.

Figure 6:
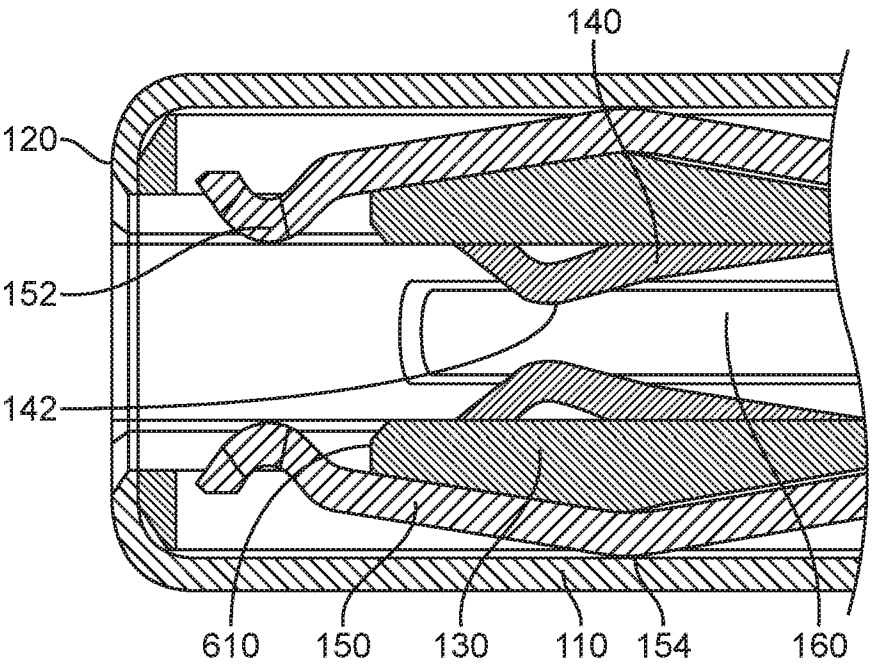
FIG. 6 illustrates a closer view of a portion of a connector insert according to an embodiment of the present invention.

FIG. 6 illustrates a closer cutaway view of a portion of a connector insert according to an embodiment of the present invention. Again, ground shield 110 may be located around first contacts 140 and second contacts 150. Front portion 120 may define an opening at a front of the connector insert. First contacts 140 may include contacting portions 142, while second contacts 150 may include contacting portions 152. The connector insert may include side ground contacts 160. First contacts 140 may be supported by front housing portion 130. Specifically, first contacts 140 may be located inside an opening in front housing portion 130. The opening in front housing portion 130 may accept a tongue, such as tongue 210 of the connector receptacle in FIG. 2. Second contacts 150 may be supported by outer sides of front housing portion 130. Contacting portions 152 may be in front of front housing portion 130. That is, contacting portions 152 may be located between a front 610 of front housing portion 130 and an opening defined by front portion 120.

Figure 7:
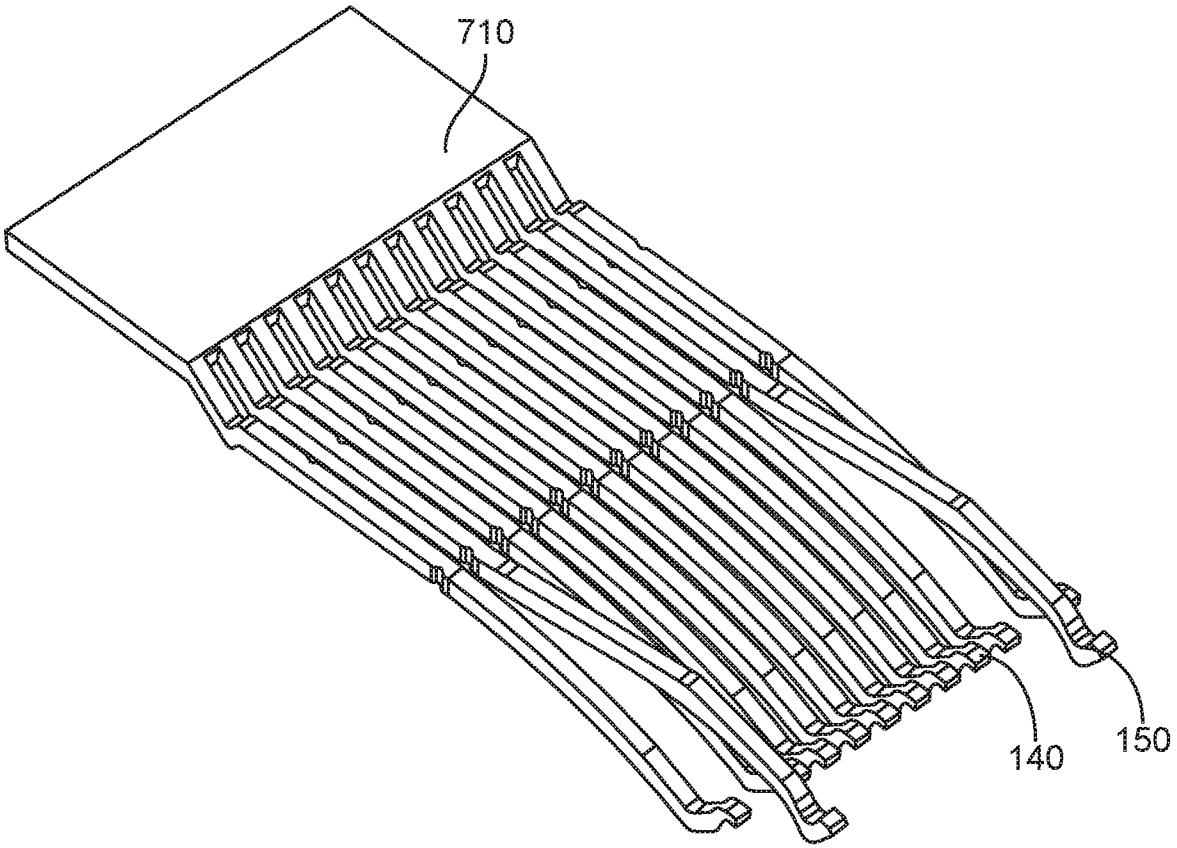
FIG. 7 illustrates a number of contacts that may be manufactured together according to an embodiment of the present invention.

FIG. 7 illustrates a number of contacts that may be manufactured together according to an embodiment of the present invention. In this example, first contacts 140 and second contacts 150 may be formed or stamped as a unit from a single piece of sheet metal. First contacts 140 and second contacts 150 may instead be formed by 3-D printing, metal-injection molding, or other process. Carrier 710 may be used to keep first contacts 140 and second contacts 150 together during manufacturing of the contacts and assembly of a connector insert. At an appropriate time, carrier 710 may be detached from first contacts 140 and second contacts 150, thereby electrically separating these contacts from each other.

Connector inserts may be manufactured in different ways according to various embodiments of the present invention. One example is shown in the following figure.

Figure 8:
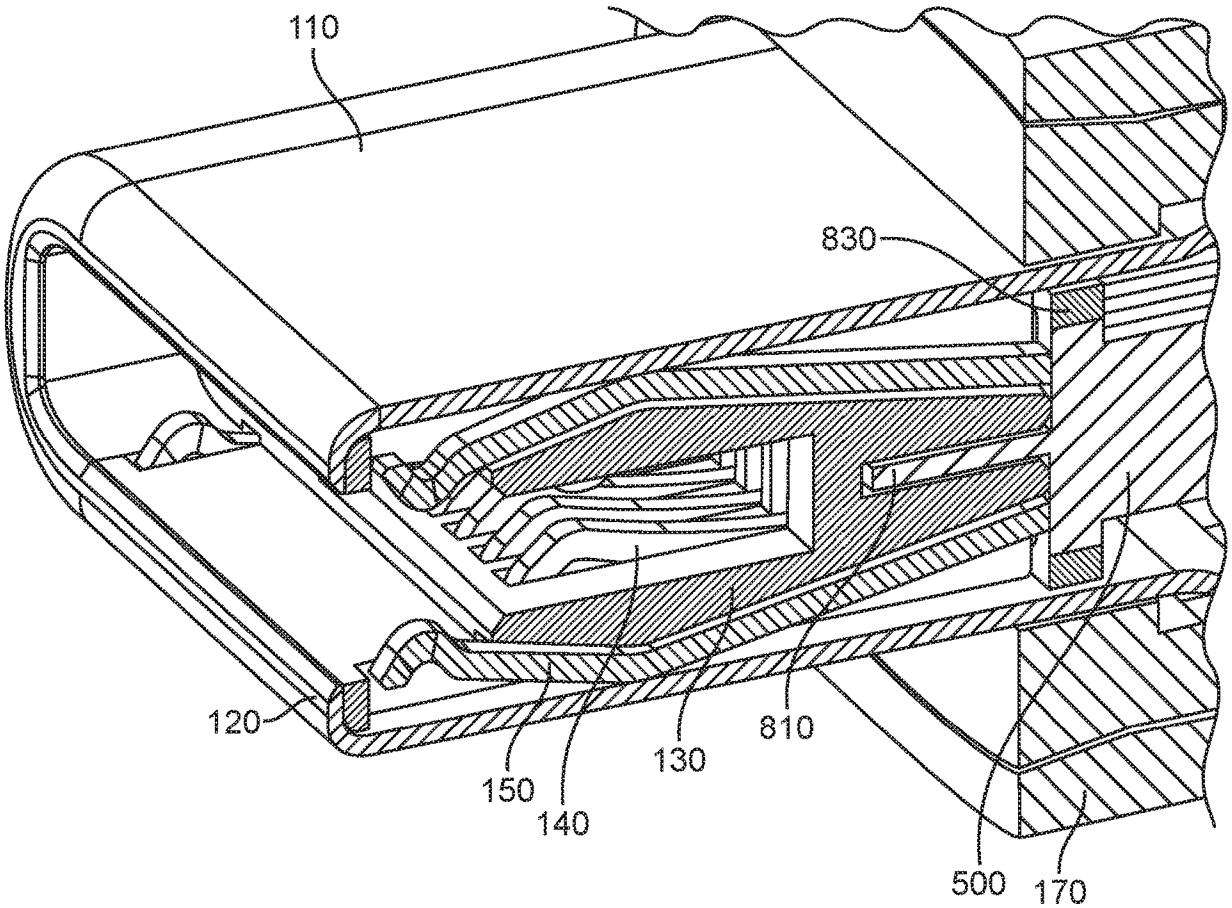
FIG. 8 illustrates a cutaway side view of a connector insert according to an embodiment of the present invention.

FIG. 8 illustrates a cutaway side view of a connector insert according to an embodiment of the present invention. Again, shield 110 may support front portion 120 that forms an opening and a front of the connector insert. Shield 110 may be placed around first contacts 140 and second contacts 150.

During assembly, a sensor ground plane 810 may be provided. This sensor ground plane may isolate signals on contacts on the top and bottom of the connector insert from each other. A first molded portion 500 may be molded around central ground plane 810. First molded portion 500 may include slots to accept first contacts 140 and second contacts 150. These slots may be located on top and bottom of first molded portion 820. After first contacts 140 and second contacts 150 are placed in the slots, top and bottom caps 830 may be used to secure first contacts 140 and second contacts 150 in place. Front molded portion 130 may then be placed over a portion of center ground plane 810 and used to support first contacts 140 and contacts 150. Shield 110 and front portion 120 may then be added.

In various embodiments of the present invention, first and second contacts, shields, ground planes, and other conductive portions of connector inserts and receptacles may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), or other nonconductive material or combination of materials. The printed circuit boards used may be formed of FR-4, BT or other material. Printed circuit boards may be replaced by other substrates, such as flexible circuit boards, in many embodiments of the present invention.

Embodiments of the present invention may provide connector structures that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connector inserts and receptacles may provide pathways for signals that are compliant with various standards such as Universal Serial Bus (USB), a High-Definition Multimedia Interface (HDMI), Digital Visual Interface (DVI), power, Ethernet, DisplayPort, Thunderbolt, Lightning and other types of standard and non-standard interfaces that have been developed, are being developed, or will be developed in the future. Other embodiments of the present invention may provide connector inserts that may be used to provide a reduced set of functions for one or more of these standards. In various embodiments of the present invention, these interconnect paths provided by these connector inserts and receptacles may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector insert comprising:

a front opening having a major axis, a minor axis, and a centerline along a center of the major axis;

a first plurality of contacts along a bottom side of the front opening, the first plurality of contacts having contacting portions at a first distance below the centerline and at a first depth behind the front opening, a second plurality of contacts along the bottom side of the front opening, the second plurality of contact having contacting portions at a second distance below the centerline and a second depth behind the front opening, the first distance different from the second distance and the first depth different from the second depth; and a first housing portion, wherein the contacting portions of the first plurality of contacts are above the first housing portion and behind a leading edge of the first housing portion and the contacting portions of the second plurality of contacts are located between the opening and the leading edge of the first housing portion.

2. The connector insert of claim 1 wherein the second plurality of contacts consists of two contacts.

3. The connector insert of claim 1 further comprising a shield around the first plurality of contacts and second plurality of contacts.

4. The connector insert of claim 3 wherein each of the second plurality of contacts includes a shield contact portion and is in contact with the shield at the shield contact portion.

5. The connector insert of claim 1 wherein the first distance is less than the second distance and the first depth is greater than the second depth.

6. A connector insert comprising:

a front opening having a major axis, a minor axis, and a centerline along a center of the major axis;

a first plurality of contacts along a bottom side of the front opening, the first plurality of contacts having contacting portions at a first distance below the centerline and at a first depth behind the front opening, a second plurality of contacts along the bottom side of the front opening, the second plurality of contact having contacting portions at a second distance below the centerline and a second depth behind the front opening, the first distance different from the second distance and the first depth different from the second depth;

a third plurality of contacts along a top side of the front opening, the third plurality of contacts having contacting portions at the first distance above the centerline and at the first depth behind the front opening, and a fourth plurality of contacts along the top side of the front opening, the fourth plurality of contact having contacting portions at the second distance above the centerline and the second depth behind the front opening.

7. The connector insert of claim 6 wherein the first distance is less than the second distance and the first depth is greater than the second depth.

8. The connector insert of claim 6 wherein the fourth plurality of contacts consists of two contacts.

9. The connector insert of claim 6 further comprising a first housing portion, wherein the contacting portions of the first plurality of contacts are above the first housing portion and behind a leading edge of the first housing portion and the contacting portions of the second plurality of contacts are located between the opening and the leading edge of the first housing portion.

10. The connector insert of claim 6 further comprising a shield around the first, second, third, and fourth pluralities of contacts.

11. The connector insert of claim 10 wherein each of the second plurality of contacts includes a shield contact portion and is in contact with the shield at the shield contact portion.

12. The connector insert of claim 10 wherein each of the second plurality of contacts and each of the fourth plurality of contacts includes a shield contact portion and is in contact with the shield at the shield contact portion.

13. A connector insert comprising:

a shield around an inserting portion;

a first molded portion;

a first plurality of contacts near a bottom side of the connector insert, each of the first plurality of contacts substantially straight between the first molded portion and a contacting portion; and a second plurality of contacts separate from the shield and near the bottom side of the connector insert, each of the second plurality of contacts having a first downward angled portion between the first molded portion and a shield contact portion and a second upward angled portion between the shield contact portion and a contacting portion, wherein each of the second plurality of contacts is in contact with the shield at a shield contact portion.

14. The connector insert of claim 13 wherein the second plurality of contacts consists of two contacts.

15. The connector insert of claim 13 further comprising:

a third plurality of contacts near a top side of the connector insert, each of the first plurality of contacts substantially straight between the first molded portion and a contacting portion; and a fourth plurality of contacts near the top side of the connector insert, each of the second plurality of contacts having a first upward angled portion between the first molded portion and a shield contact portion and a second downward angled portion between the shield contact portion and a contacting portion.

16. The connector insert of claim 15 wherein each of the fourth plurality of contacts is in contact with the shield at a shield contact portion.

17. The connector insert of claim 15 wherein the shield is around the first, second, third, and fourth plurality of contacts.

18. A connector insert comprising:

a shield around an inserting portion;

a first molded portion;

a first plurality of contacts near a bottom side of the connector insert, each of the first plurality of contacts substantially straight between the first molded portion and a contacting portion; and a second plurality of contacts separate from the shield and near the bottom side of the connector insert, each of the second plurality of contacts having a first downward angled portion between the first molded portion and a shield contact portion and a second upward angled portion between the shield contact portion and a contacting portion, wherein the first plurality of contacts has contacting portions at a first distance below the centerline and at a first depth behind the front opening, the second plurality of contact has contacting portions at a second distance below the centerline and a second depth behind the front opening, the first distance different from the second distance and the first depth different from the second depth, wherein the first distance is less than the second distance and the first depth is greater than the second depth, and wherein the third plurality of contacts has contacting portions at the first distance above the centerline and at the first depth behind the front opening, and the fourth plurality of contact has contacting portions at the second distance above the centerline and the second depth behind the front opening.

19. A connector insert comprising:

a shield;

a first plurality of contacts along top and bottom sides of the connector insert, the first plurality of contacts having contacting portions to form electrical connections with contacts on a surface of a connector receptacle tongue, and a second plurality of contacts separate from the shield and along top and bottom sides of the connector insert, the second plurality of contacts having contacting portions to form electrical connections with a ground contact on the connector receptacle tongue and shield contacting portions to form electrical connections with the shield.

20. The connector insert of claim 19 wherein the first plurality of contacts has contacting portions at a first distance away from a centerline and at a first depth behind a front opening, the centerline along a center of a major axis of the front opening, and the second plurality of contact has contacting portions at a second distance away from the centerline and a second depth behind the front opening, the first distance different from the second distance and the first depth different from the second depth.

21. The connector insert of claim 19 wherein each of the first plurality of contacts substantially straight between a first molded portion and a contacting portion; and each of the second plurality of contacts has a first angled portion between the first molded portion and a shield contact portion and a second angled portion between a shield contact portion and a contacting portion, wherein each of the second plurality of contacts is in contact with a shield at a shield contact portion.

* * * * *